US010631622B1

(12) United States Patent
Selvan

(10) Patent No.: US 10,631,622 B1
(45) Date of Patent: Apr. 28, 2020

(54) TOOTHBRUSH WITH REPLACEABLE BRISTLE HEAD

(71) Applicant: Vaidya Selvan, Marlboro, NJ (US)

(72) Inventor: Vaidya Selvan, Marlboro, NJ (US)

( * ) Notice: Subject to any disclaimer, the term of this patent is extended or adjusted under 35 U.S.C. 154(b) by 9 days.

(21) Appl. No.: 16/177,529

(22) Filed: Nov. 1, 2018

(51) Int. Cl.
*A46B 7/04* (2006.01)
*A46B 9/04* (2006.01)

(52) U.S. Cl.
CPC ..... *A46B 7/044* (2013.01); *A46B 9/04* (2013.01); *A46B 2200/1066* (2013.01)

(58) Field of Classification Search
CPC .... A46B 7/044; A46B 9/04; A46B 2200/1066
See application file for complete search history.

(56) References Cited

U.S. PATENT DOCUMENTS 1,682,325 A * 8/1928 Amico ..... A46B 7/04 15/176.1
2,893,036 A 7/1959 Filler et al.
2,946,072 A * 7/1960 Filler ..... A46B 7/04 15/110
3,103,680 A * 9/1963 Krichmar ..... A46B 7/04 15/167.1
3,174,174 A * 3/1965 Dengler ..... A46B 7/04 401/25
3,369,265 A * 2/1968 Halberstadt ..... A61C 17/32 15/22.1
3,879,139 A * 4/1975 Dahl ..... A46B 11/0003 401/135
5,224,234 A * 7/1993 Arsenault ..... A46B 5/0033 15/167.1
6,039,050 A * 3/2000 Goldenberg ..... A46B 7/04 132/309
6,487,748 B1 * 12/2002 Dardar ..... A46B 7/04 15/167.1
6,920,659 B2 7/2005 Cacka et al.
8,448,287 B2 * 5/2013 Ponzini ..... A46B 7/042 15/176.1

FOREIGN PATENT DOCUMENTS

EP 2792271 A1 10/2014
KR 200171064 Y1 * 3/2000
(Continued)

OTHER PUBLICATIONS

KR-20140148155-A—English Machine Translation (Year: 2014).*

*Primary Examiner* — Marc Carlson
(74) *Attorney, Agent, or Firm* — Lawrence B. Goodwin; Mandelbaum Salsburg P.C.

(57) ABSTRACT

A toothbrush having a replaceable bristle base including, in combination, a handle having a long dimension, and having a head portion providing a top surface, and a longitudinal slot in the top surface along the long dimension of the handle; and a bristle base having bristles extending from an upper surface, a bottom surface, and a longitudinal protrusion extending from its bottom surface, wherein the longitudinal protrusion in said bristle base conforms in contour and size to the longitudinal slot in the handle, and the bottom surface of said bristle base conforms in contour and size to the top surface of the head portion of said handle, so that the bristle base can be selectively inserted into, and removed from, the head portion of the handle.

9 Claims, 2 Drawing Sheets

(56) References Cited

FOREIGN PATENT DOCUMENTS

| | | | | |
|---|---|---|---|---|
| KR | 200437728 | Y1 | * | 12/2007 |
| KR | 200437728 | Y1 | | 12/2007 |
| KR | 200466528 | Y1 | * | 4/2013 |
| KR | 101321571 | B1 | * | 10/2013 |
| KR | 101427320 | B1 | * | 8/2014 |
| KR | 20140148155 | A | * | 12/2014 |

* cited by examiner

TOOTHBRUSH WITH REPLACEABLE BRISTLE HEAD

The present invention is directed to a toothbrush that is comprised of a reusable handle and a replaceable bristle head.

BACKGROUND OF THE INVENTION

Plastic accumulating in our oceans, on land and on our beaches has become a global crisis and a major problem affecting the ecology and our environment. Billions of pounds of plastic can be found in swirling convergences that make up a large percentage of the world's ocean surface. As Humans we do not seem to care about it nor are we taking any measures to curtail them. Microplastics are seen everywhere from the water we drink to the food we eat.

One of the many sources of such pollution is from plastic toothbrushes which end up primarily in the landfills and also in various sources of our water supply. Although it is a small contributor to the overall problem, it is nevertheless significant because, inter alia, dental guidelines typically recommend changing a toothbrush every three months or whenever we see the bristles swaying away from each other. In the U.S., there are 320 million people—if those 320 million people change their toothbrush every three months, that amounts to a massive 1.28 billion toothbrushes ending up in our landfills each and every year. Now when we factor in the entire world population, it becomes truly enormous and the scale becomes very clear.

SUMMARY OF THE INVENTION

It is therefore an object of the present invention to help reduce plastic toothbrushes as a contributor to the problem of plastic pollution.

In accordance with a first embodiment of the invention a toothbrush having a replaceable bristle base includes, in combination, a handle having a long dimension, and having a head portion providing a top surface, and a longitudinal slot in the top surface along the long dimension of the handle; and a bristle base having bristles extending from an upper surface, a bottom surface, and a longitudinal protrusion extending from its bottom surface, wherein the longitudinal protrusion in said bristle base conforms in contour and size to the longitudinal slot in the handle, and the bottom surface of said bristle base conforms in contour and size to the top surface of the head portion of said handle, so that the bristle base can be selectively inserted into, and removed from, the head portion of the handle.

Alternatively, the present invention is directed to replaceable bristle base, for insertion into a handle having (i) a long dimension, (ii) a head portion providing a top surface and (iii) a longitudinal slot in the top surface along the long dimension of the handle, the bristle base comprising bristles extending from an upper surface, a bottom surface, and a longitudinal protrusion extending from its bottom surface, wherein said longitudinal protrusion in said bristle base conforms in contour and size to the longitudinal slot in said handle, and the bottom surface of said bristle base conforms in contour and size to the top surface of the head portion of the handle, so that the bristle base can be selectively inserted into, and removed from, the head portion of the handle.

In accordance with preferred embodiments, the toothbrush the longitudinal protrusion in the bristle base and the longitudinal slot in the handle can be wedge-shaped, the bottom surface of the bristle base and the top surface of the head portion of the handle have an upwardly sloping region such that the bristle base can be inserted into said handle in a sled-like manner. The bristle base may further include notches to facilitate its insertion and removal into and from said handle. The handle is preferably made of stainless steel and the bristle base of plastic. These materials may vary, however, and could be made of wood, recycled plastic, or other suitable materials.

These and other objects of the invention will be described in detail below, with reference to the following drawing figures.

DETAILED DESCRIPTION OF THE INVENTION

Figure 1A:
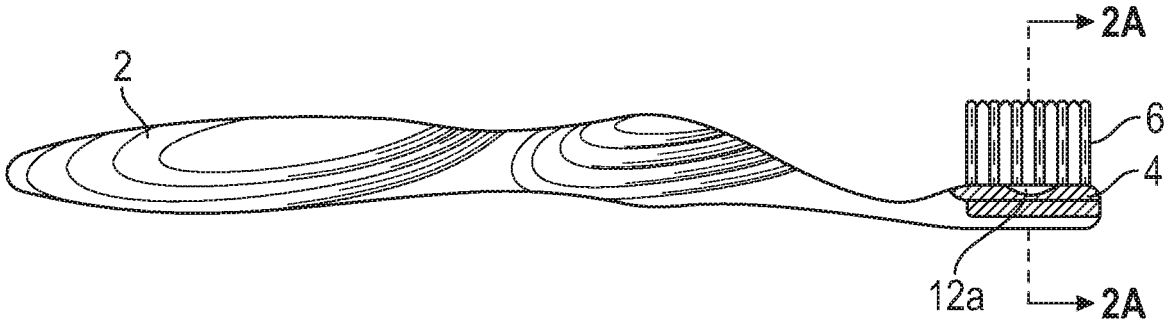
FIGS. 1A-1B are side and top views of the entire toothbrush in assembled form.
Figure 1B:
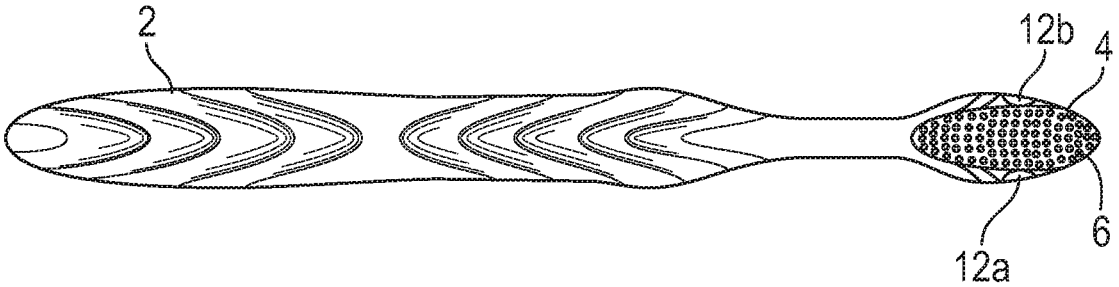
Figure 2A:
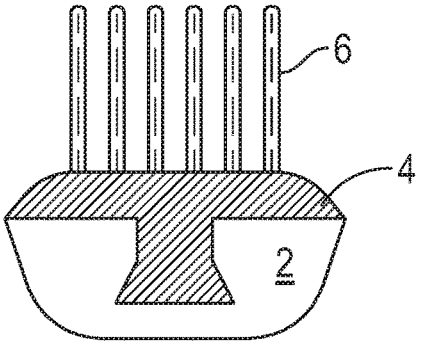
FIG. 2A is a cross-sectional view of the assembled handle and bristle head of FIG. 1A from the front.
Figure 2B:
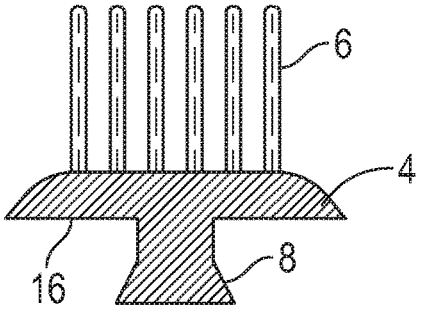
FIGS. 2B-2C illustrate the handle and bristle head of FIG. 2A separated from one another, also from the front.
Figure 2C:
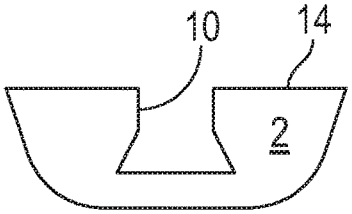

With reference to all of the figures, the toothbrush in accordance with the present invention is comprised of two components: a handle 2, which is reusable, and a slidable, replaceable bristle head comprising a bristle base 4 and bristles 6 extending from the base. In accordance with preferred embodiments, the handle 2 can be comprised of stainless steel, the base 4, which holds the bristles, is comprised of plastic, and the bristles can be nylon, although different suitable materials can be used for any of these components, as desired.

The bristle base 4 is releasably connected to the handle 2 by means of a wedge-shaped protrusion 8 which conforms in contour and size to a longitudinal slot 10, along the long dimension of the handle, such that the user can slide the bristle base 4 into the longitudinal slot 10, where it is securely held by a friction form-fit to produce the complete toothbrush. Conversely, the user can remove the bristle base 4 from the handle by sliding the base along the longitudinal slot 10 in the opposite direction, at which point the old bristle base can be discarded and a new one inserted into the handle. Notches 12*a* and 12*b* on the sides of the bristle base can be provided to facilitate the user to grip on the base when removing and inserting the base from or into the handle.

Figure 3:
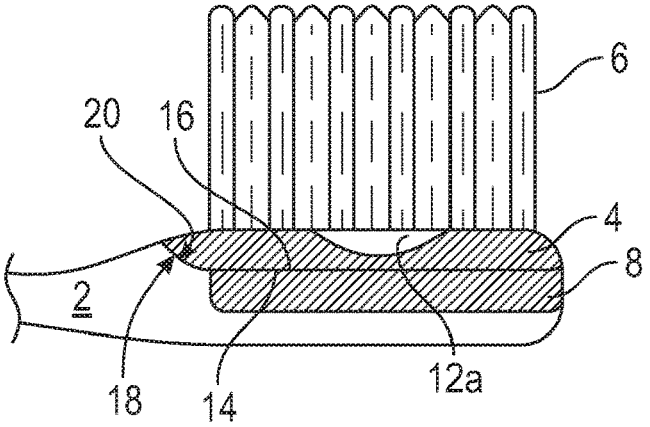
FIG. 3 is a detailed illustration of the head portion assembled-handle and bristle head of FIG. 1A.
Figure 4:
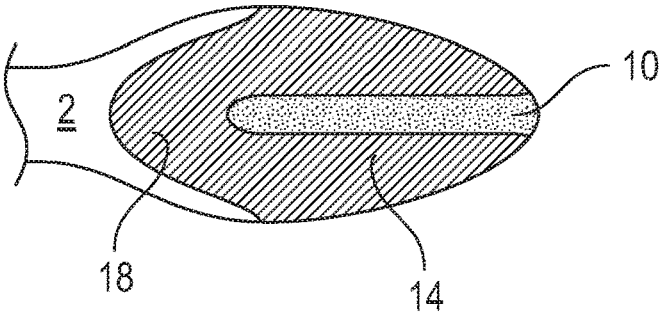
FIG. 4 is a top view of the head portion of the handle without the bristle head.

Finally, as best shown in FIGS. 3 and 4, the top surface 14 of the head portion of the handle 2 has an upward sloping region 18; conversely, the bottom surface 16 of the bristle head conforms in contour and size to the top surface 14, and includes an upward sloping region 20, which facilitates the insertion of the bristle head onto the handle in a sled-like manner, and further securely holds the bristle base within the handle by means of the frictional form-fit of the parts, to thereby enable a water tight fit between the base and the handle. This also prevents bacteria from lodging in the area.

As noted, it is recommended that a toothbrush be replaced every two to three months or when the bristles are seen swaying out from each other. In accordance with the present invention, at the time of replacement, the bristle base can be removed and discarded, and a replacement base can be inserted. Since the bristle base is much smaller than the entire toothbrush, and the handle is retained for subsequent use, it will be appreciated that the present invention drastically reduces the plastic waste when the bristles need to be replaced.

The foregoing preferred embodiments described herein are set forth as exemplary, and it will be appreciated that various modifications may be made without departing from the scope and spirit of the invention which is defined by the following claims.

I claim:

1. A toothbrush having a replaceable bristle base, comprising, in combination:

a handle having a long dimension and having a head portion having a top surface, an upwardly sloping region at an end thereof, and a longitudinal slot in said top surface along the long dimension of the handle; and a unitary bristle base having an upper surface, a bottom surface, an upwardly sloping region at an end thereof, bristles extending from said upper surface, and a longitudinal protrusion extending from its bottom surface, wherein said longitudinal protrusion in said bristle base conforms in contour and size to said longitudinal slot in said handle, said bottom surface of said bristle base conforms in contour and size to the top surface of said head portion of said handle, so that the bristle base can be selectively inserted into, and removed from, the head portion of the handle, and said upwardly sloping region in said head portion conforms in size and contour to said upwardly sloping region of said bristle base such that said bristle base can be inserted into said handle in a sled-like manner.

2. The toothbrush of claim 1, wherein said longitudinal protrusion in said bristle base and said longitudinal slot in said handle are wedge-shaped.

3. The toothbrush of claim 1 wherein said bristle base includes notches on opposite lateral sides of said bristle base so that a user can grip said notches to facilitate its insertion and removal into and from said handle.

4. The toothbrush of claim 1 wherein said handle is comprised of stainless steel, said bristles are comprised of nylon, and said bristle base is comprised of plastic.

5. The toothbrush of claim 1 wherein the bottom surface of the bristle base and the top surface of the head portion of the handle conform to each other such that the handle securely holds the bristle base by means of a frictional form-fit, to thereby enable a water tight fit between the bristle base and the handle.

6. A replaceable bristle base, for insertion into a handle having (i) a long dimension, (ii) a head portion having a top surface, (iii) an upwardly sloping region at an end thereof, and (iv) a longitudinal slot in said top surface along the long dimension of the handle, said bristle base comprising:

a unitary upper surface, a bottom surface, and an upwardly sloping region at an end thereof, bristles extending from said upper surface, and a longitudinal protrusion extending from its bottom surface, wherein said longitudinal protrusion in said bristle base conforms in contour and size to said longitudinal slot in said handle, said bottom surface of said bristle base conforms in contour and size to the top surface of said head portion of said handle, so that the bristle base can be selectively inserted into, and removed from, the head portion of the handle, and said upwardly sloping region in said head portion conforms in size and contour to said upwardly sloping region of said bristle base such that said bristle base can be inserted into said handle in a sled-like manner.

7. The replaceable bristle base of claim 6, wherein said longitudinal protrusion in said bristle base is wedge-shaped.

8. The replaceable bristle base of claim 6 wherein said bristle base includes notches on opposite lateral sides of said bristle base so that a user can grip said notches to facilitate its insertion and removal into and from said handle.

9. The replaceable bristle base of claim 6 wherein said bristle base is comprised of plastic, and said bristles are comprised of nylon.

* * * * *